US005426351A

United States Patent [19]

Imura

[11] Patent Number: 5,426,351

[45] Date of Patent: Jun. 20, 1995

[54] HEATER COIL FOR ELECTRON TUBE

[75] Inventor: Hironori Imura, Tokyo, Japan

[73] Assignee: NEC Corporation, Japan

[21] Appl. No.: 287,712

[22] Filed: Aug. 9, 1994

Related U.S. Application Data

[63] Continuation of Ser. No. 904,151, Jun. 25, 1992, abandoned.

[30] Foreign Application Priority Data

Jun. 25, 1991 [JP] Japan ..... 3-152683

[51] Int. Cl.[6] ..... H01J 1/20

[52] U.S. Cl. ..... 313/337; 313/342; 313/344; 219/553; 338/62; 338/298; 338/299

[58] Field of Search ..... 313/337, 338, 341, 342, 313/343, 344, 346 R, 346 DC, 270; 219/552, 553; 338/61, 62, 63, 296, 298, 299

[56] References Cited

U.S. PATENT DOCUMENTS

| | | | |
|---|---|---|---|
| 1,918,259 | 7/1933 | Gabriel | 338/61 X |
| 1,972,720 | 9/1934 | Tarpley et al. | 338/61 |
| 2,715,671 | 8/1955 | Harrison | 338/299 X |
| 2,909,701 | 10/1959 | Okress | 313/278 |
| 3,259,784 | 7/1966 | Vogel | 313/337 X |
| 4,002,884 | 1/1977 | Weiss | 338/296 X |
| 4,434,417 | 2/1984 | Beriger et al. | 338/61 X |
| 5,081,341 | 1/1992 | Rowe | 338/63 X |

FOREIGN PATENT DOCUMENTS

| | | |
|---|---|---|
| 0950881 | 10/1949 | France . |
| 0072023 | 4/1988 | Japan . |

OTHER PUBLICATIONS

Pages 47 to 70 of "Varian Associates Technical Memorandom TMO-59", Thermal Design of Cathodes for Klystrons, Feb. 1962.

*Primary Examiner*—Sandra L. O'Shea
*Assistant Examiner*—Ashok Patel
*Attorney, Agent, or Firm*—Laff, Whitesel, Conte & Saret

[57] ABSTRACT

A heater coil for an electron tube includes a spiral wire which is double wound to be cylindrical, and a connection wire which is formed on an upper face of the spiral wire in a horizontal plane. The connection wire is shaped to have at least two bent portions on the same plane.

7 Claims, 7 Drawing Sheets

HEATER COIL FOR ELECTRON TUBE

This application is a continuation of application Ser. No. 07/904,151, filed Jun. 25, 1992 now abandoned.

FIELD OF THE INVENTION

This invention relates to a heater coil for heating a cathode of an electron tube.

BACKGROUND OF THE INVENTION

Recently, an indirect heated cathode is used for an electron tube such as a TWT (travellingwave tube) an a klystron. The cathode is usually heated by a heater coil positioned thereunder. In the electron tube, when the cathode is heated to a predetermined temperature, thermionics are emitted from an emission face of the cathode.

A first conventional heater coil of a side-cross-single-spiral type is made of a single wire including a spiral wire double wound to be cylindrical and lead wires extending to a vertical direction for being connected to a power supply. The heater coil is provided with a U shaped bent portion at a top thereof.

In the conventional electron tube, when a predetermined voltaghe is applied to the lead wires, the cathode pellet is heated, and thermionics are emitted from the emission face of the cathode pellet.

A second conventional heater coil of top-cross-single-spiral type is made of a single wire including a spiral wire double-wound to be cylindrical, a connection wire extending in a diametral direction of the spiral wire, and lead wires connected to a power supply.

A third conventional heater coil of top-cross-double-spiral type is shaped to be top-cross-single-spiral shape in the same manner as the second conventional heater coil by using a spiraled wire.

According to the first to third conventional heater coils, however there is a disadvantage in that electrons emitted from the cathode are disturbed by a magnetic field generated to be changed around the heater coil heated by an AC power supply. Therefore, a noise is included in an output signal amplified by the electron tube.

SUMMARY OF THE INVENTION

Accordingly, it is an object of the invention to provide a heater coil for an electron tube in which emission of thermionics is not disturbed by a magentic field generated around the heater coil.

According to the invention, a heater coil for an electron tube, includes:

a pair of lead wires positioned on two opposite points on a circle defined to have a predetermined radius, the lead wires being connected to an AC power supply;

a heater of cylindrical shape having the predetermined radius defined by winding first and second wires spirally, the first and second wires being adjacent in a substantially whole length and separated on two opposite points of a tope plane circle and a bottom plane circule of the cylindrical shape, the first and second wires being connected on the bottom plane circule to the lead wires correspondingly; and a connection wire for connecting the first and second wire by extending from first to second points of the two opposite points on the top plane circle, the connection wire being bent at least at two points to provide a least three segment portions, whereby magnetic fields generated by at least two segment portions of the at least three segment portions are cancelled.

BRIEF DESCRIPTION OF THE DRAWINGS

The invention will be explained in more detail in conjunction with appended drawings; wherein.

DESCRIPTION OF THE PREFERRED EMBODIMENTS

Before describing a heater coil for an electron tube according to the invention, the briefly aforementioned conventional heater coils will be explained in conjunction with FIGS. 1 to 9.

Figure 1:
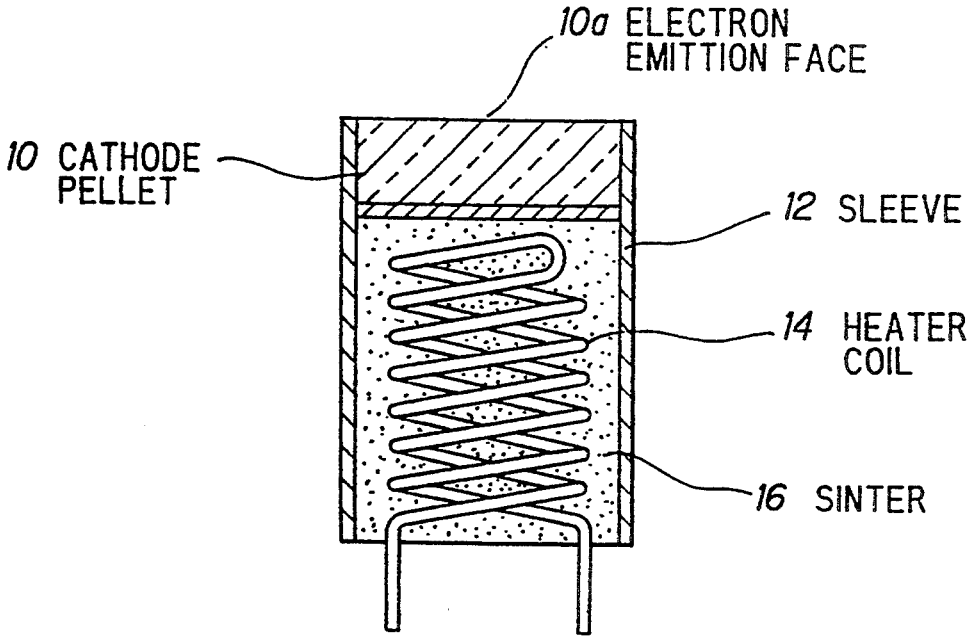
FIG.1 PRIOR ART
FIG. 1 is an axial sectional view showing an electron tube using a first conventional heater coil.

FIG. 1 shows a conventional electron tube which includes a cathode pellet 10 in which electron emission material is contained, a sleeve 12 fixed to the cathode pellet 10 by brazing, a heater coil 14 of side-single-spiral type positioned in the sleeve 12, and a sinter 16 made from alumina powder or iron powder for holding the heater coil 14 in the sleeve 12. The cathode pellet 10 is provided with an electron emission face 10*a* having a diameter of less than 15 mm.

Figure 2:
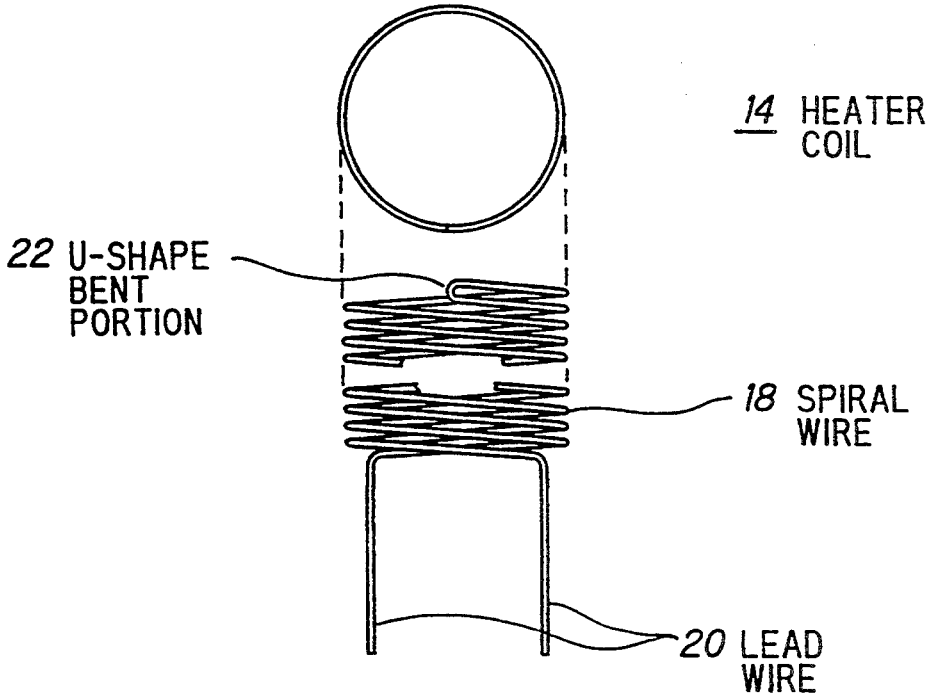
FIG.2 PRIOR ART
FIG. 2 is a top-and-front view showing the first conventional heater coil.

FIG. 2 shows the heater coil 14 which is made of a single wire including a spiral wire 18 double-wound to be cylindrical and lead wires 20 extending to a vertical direction for being connected to a power supply (not shown). The heater coil is provided with a U shaped bent portion 22 at a top thereof.

In the conventional electron tube, when a predetermined voltage is applied to the lead wires 20, the cathode pellet 10 is heated, and thermionics are emitted from the emission face 10*a* of the cathode pellet 10.

Figure 3:
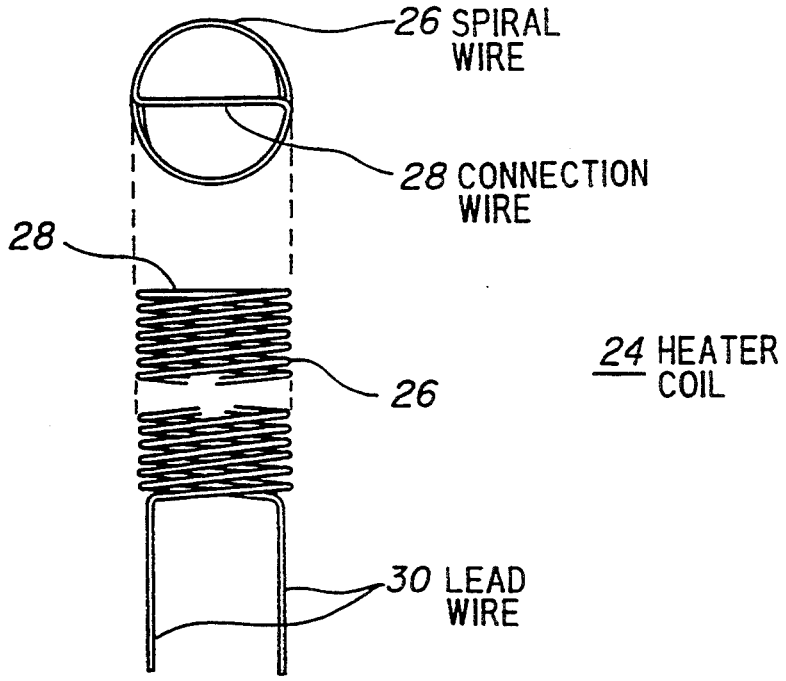
FIG.3 PRIOR ART
FIG. 3 is a top-and-front view showing a second conventional heater coil.

FIG. 3 shows a second conventional heater coil 24 of top-cross-single-spiral type which is made of a single wire including a spiral wire 26 double-wound to be cylindrical, a connection wire 28 extending in a diametral direction of the spiral wire 26, and lead wires 30 connected to a power supply (not shown).

Figure 4:
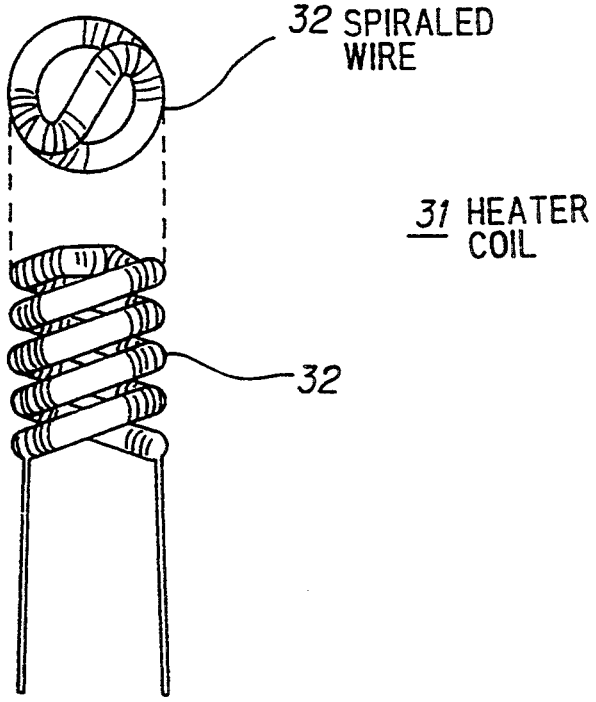
FIG.4 PRIOR ART
FIG. 4 is a top-and-front view showing a third conventional heater coil.

FIG. 4 shows a third conventional heater coil 31 of top-cross-double-spiral type which is shaped to be top-cross-single-spiral shape in the same manner as the second conventional haeater coil 24 by using a spiraled wire 32.

According to the first to third conventional heater coils 14, 24 and 31, however there is a disadvantage in that electrons emitted from the cathode is distrubed by a magnetic field generated around the coils 14, 24 and 31. Therefore, a noise is included in an output signal of the electron tube. This probelm is serious for a cathode having a short distance between an electron emission face and a heater coil.

Next, conventional heater coils used in an electron tube in which a cathode has a diameter of over 15 mm will be explained.

Figure 5:
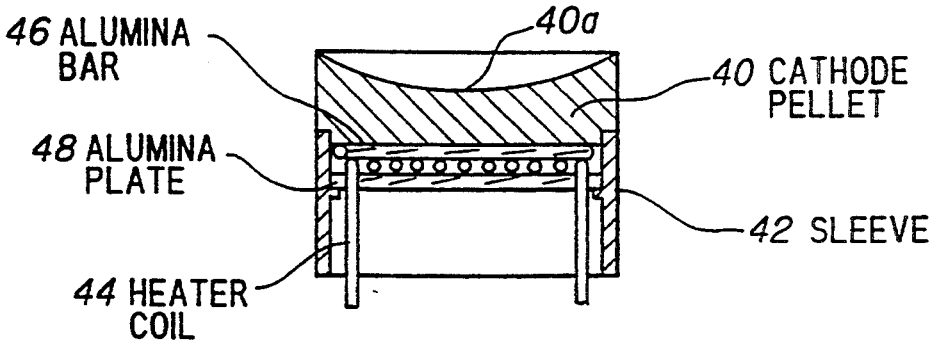
FIG.5 PRIOR ART
FIG. 5 is an axial sectional view showing an electron tube using a fourth conventional heater coil.

FIG. 5 shows a conventional electron tube which includes a cathode pellet 40, a sleeve 42 fixed to the cathode pellet 40 by brazing, a fourth conventional heater coil 44, and an alumina bar 46 and an alumina plate 48 for fixing the heater coil 44. The cathode pellet 40 is provided with an electron emission face 40*a* having a diameter of over 15 mm.

Figure 6:
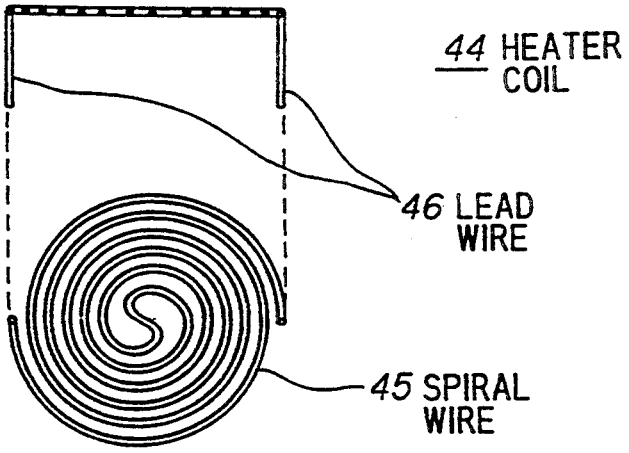
FIG.6 PRIOR ART
FIG. 6 is a top-and-front view showing the fourth conventional heater coil.

FIG. 6 shows the heater coil 44 which is made of a single wire including a spiral wire 45 double-wound on a horizontal plane, and lead wires 46 extending to a vertical direction for being connected to a power supply (not shown).

Figure 7:
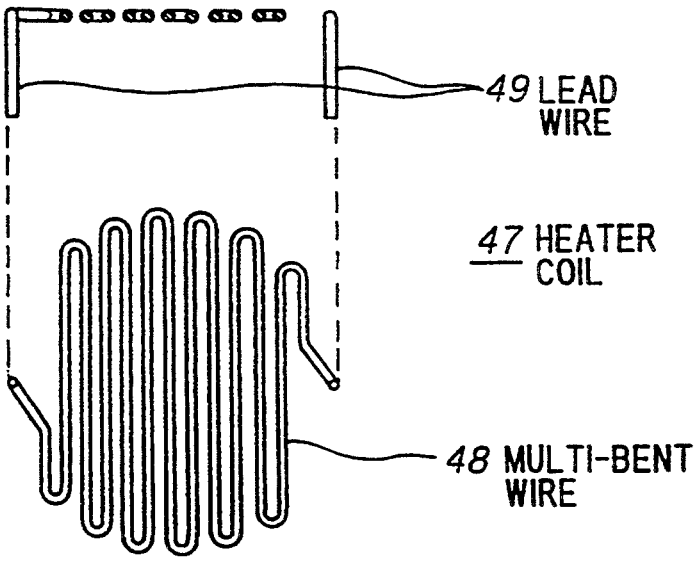
FIG.7 PRIOR ART
FIG. 7 is a top-and-front view showing a fifth conventional heater coil.

FIG. 7 shows a fifth conventional heater coil 47 which is made of a single wire including a multi-bent wire 48 which is bent meanderingly in a horizontal plane, and lead wires 49 extending to a vertical direction for being connected to a power supply (not shown).

Figure 8:
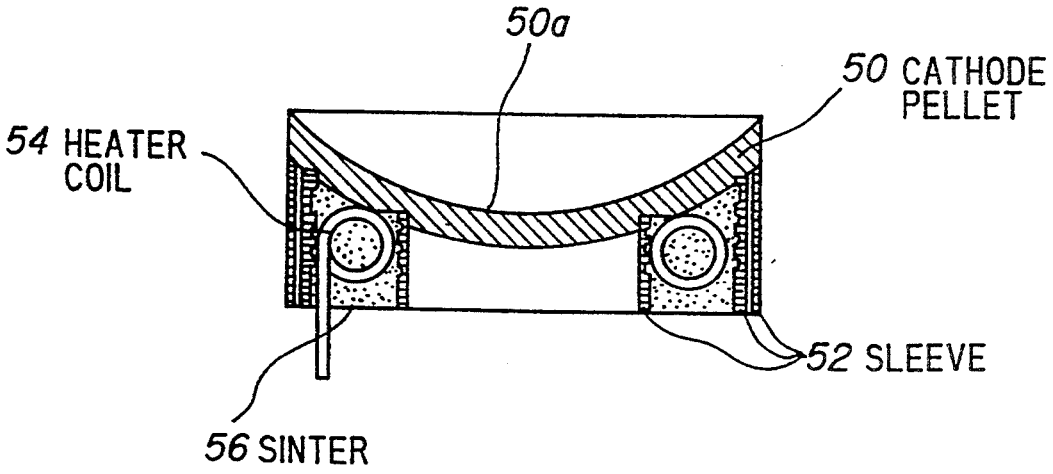
FIG. 8 PRIOR ART
FIG. 8 is an axial sectional view showing an electron tube using a sixth conventional heater coil.

FIG. 8 shows a conventional electron tube which includes a cathode pellet 50, a sleeve 52 fixed to the cathode pellet 50 by brazing, a sixth conventional heater coil 54, and a sinter 56 made from alumina powder or iron powder for holding the heater coil 54 in the sleeve 52. The cathode pellet 50 has an electron emission face 50*a* having a diameter of over 15 mm.

Figure 9:
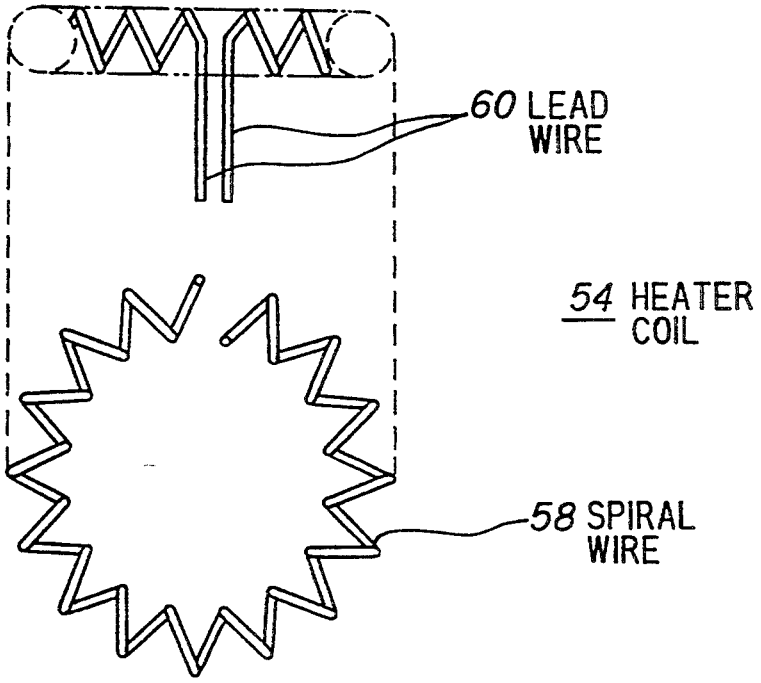
FIG. 9 PRIOR ART
FIG. 9 is a top-and-front view showing the sixth conventional heater coil.

FIG. 9 shows the sixth conventional heater coil 54 made of a single wire including a spiral wire 58 and lead wires 60 extending to a vertical direction for being connected to a power supply (not shown).

According to the fourth to sixth conventional heater coils 44, 47 and 54, a large magentic field is suppressed not to be generated around the coils 44, 47 and 54 because of the structure of lacking, for instance, the straight connection wire. However, there is a disadvantage in that the heater coils 44, 47 and 54 are not suitable for a small electron tube having a diameter of less than 15 mm due to the large size inherent to the structure.

Next, heater coils of preferred embodiments according to the invention will be explained in conjunction with FIGS. 10 to 15.

As will become more apparent, these embodiments have a cylinder formed by a spirally wound wire, the cylinder having a diamter in the range extending from less than 5 mm to 15 mm.

Figure 10:
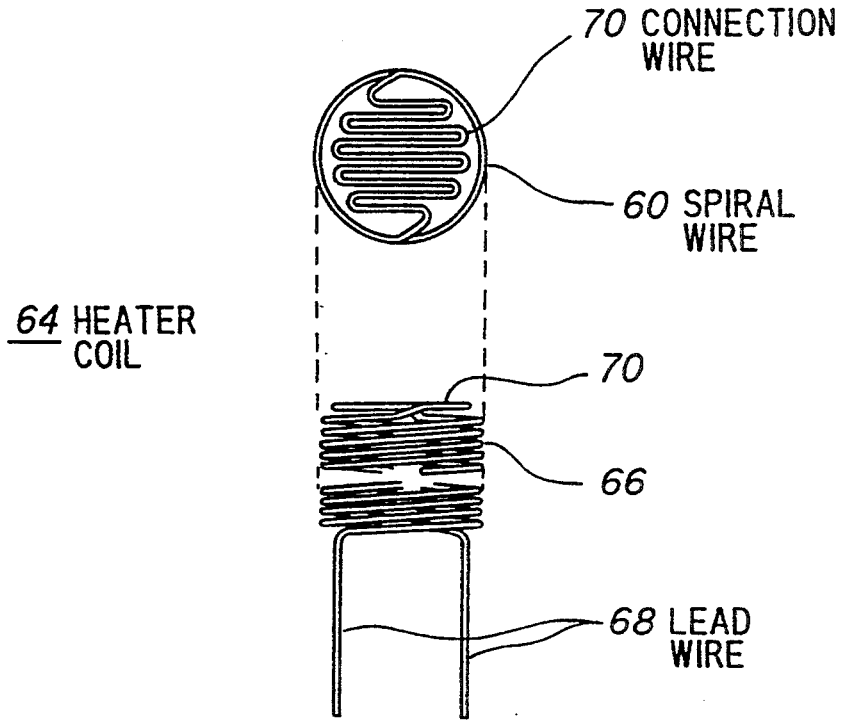
FIG. 10 is a top-and-front view showing a heater coil of a first preferred embodiment according to the invention.

FIG. 10 shows the heater coil 64 which is made of a single wire of tungsten having a diameter of 0.39 mm. The heater coil 64 includes a spiral wire 66 double-wound to be cylindrical having a diameter of 12 mm, lead wires 68 connected to a power supply (not shown), and a connection wire 70 which is shaped to be meanderingly bent.

Figure 11:
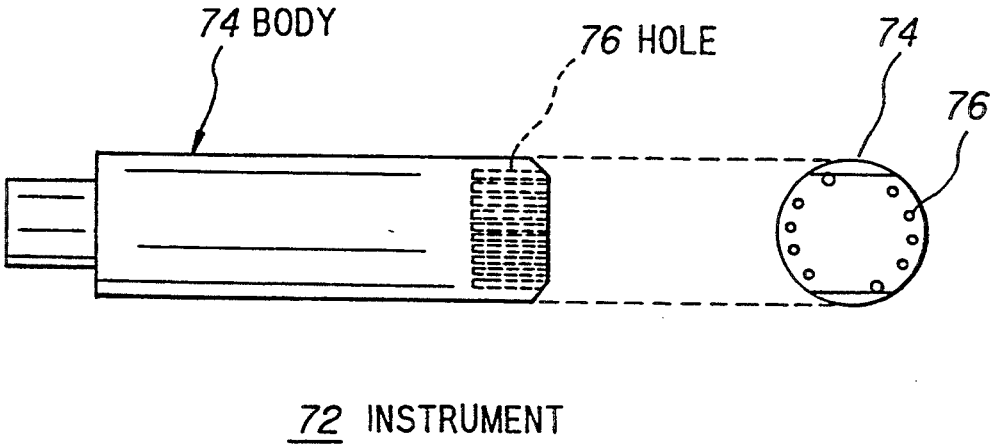
FIG. 11 is a top-and-front view showing an instrument used for shaping the heater coil of the first preferred embodiment.

FIG. 11 shows an instrument 72 used for shaping the heater coil 64, and including a cylindrical body 74 of molydenum, and holes 76 formed on one side of the body 74, into which bending pins 78 of molybdenum are inserted to stand on the side.

Figure 12:
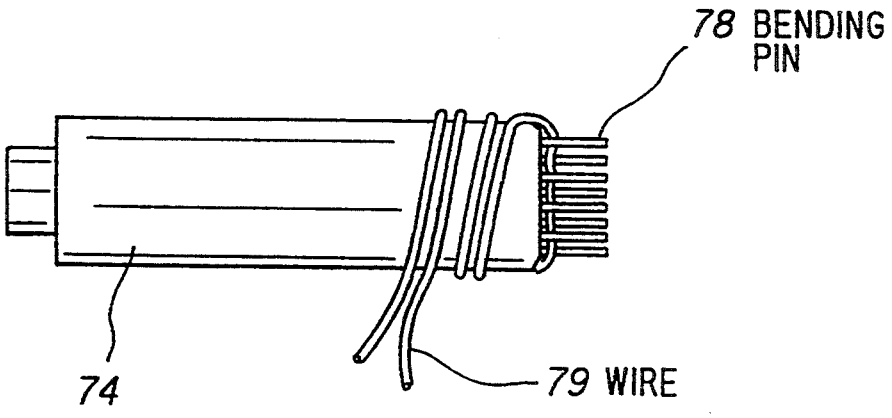
FIG. 12 is a front view showing a use of the instrument shown in FIG. 11.

In shaping, a connection wire portion of a wire 79 is bent to be patterned as shown in FIG. 10 around the bending pins 78 and a spiral wire portion of the wire 79 is wound around the body 74, as shown in FIG. 12. Then, the instrument 72 with the wound wire 79 is annealed by 1650° C. in a hydrogen atmosphere. After that, the instrument 72 is removed, so that the completely shaped heater coil 64 is obtained.

Figure 13:
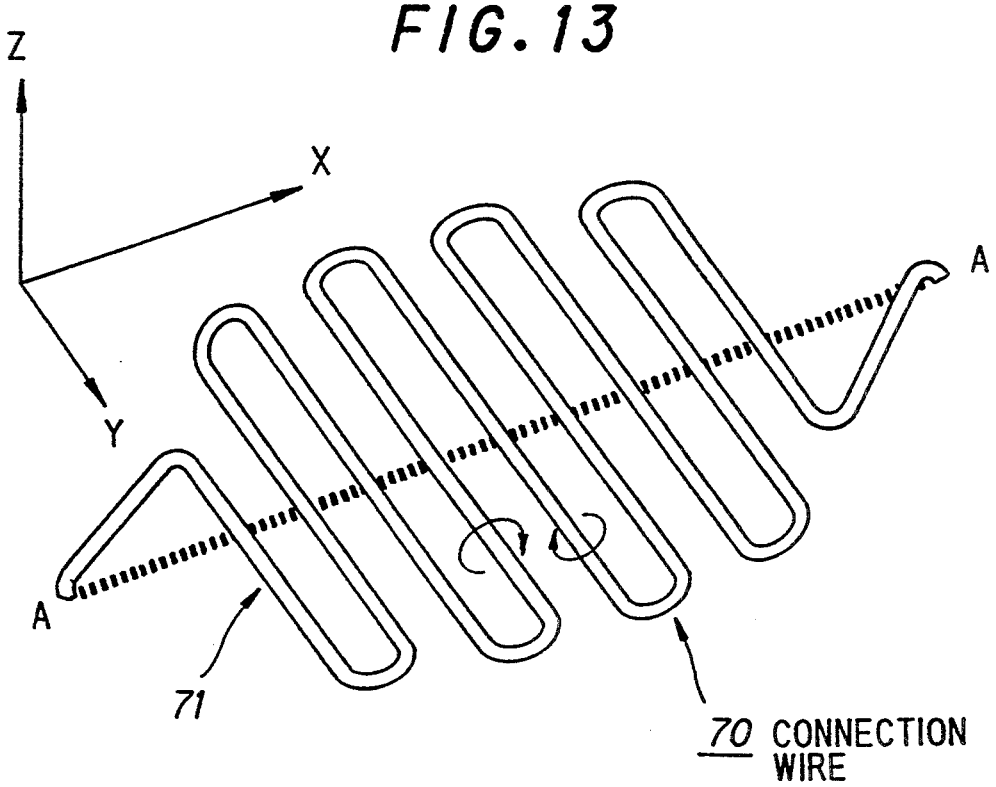
FIG. 13 is a perspective view showing a connection wire of the heater coil and a magnetic field of the first preferred embodiment.
Figure 14:
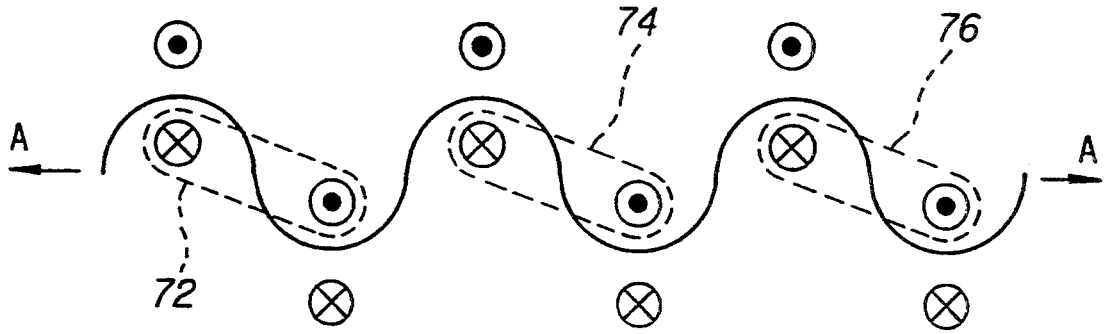
FIG. 14 is a diagram explaining magnetic field generated in the connection wire of FIG. 13.

According to the heater coil 64, two magnetic fields having opposite directions are generated around the spiral wire 66, so that the two opposite magnetic fields (positive and negative directions) are cancelled each other in a Z axis direction (longitudinal direction). Therefore, a synthesized magnetic field generated each portion of the heater coil 64 can be only a magnetic field generated on an X–Y plane, that is generated around the connection wire 70. On the connection wire 70, two opposite magnetic fields are generated alternately on Y direction wire portions 71 as shown in FIG. 13, so that the two opposite magnetic fields are cancelled each other in the Y axis direction. This phenomenon is understood y using FIG. 14 showing a magnetic field generated around the connection wire 70 which is viewed from an arbitrary view point having a sufficient long distance therefrom. In this figure, opposite direction magnetic fields 72 and 74, and 74 and 76 in the Y axis direction are cancelled each other, so that only a week magnetic field is remained thereon. This situation can be understood in the same as a case where a small electric current flows in the X axis direction, so that a only small magnetic field is generated in the X axis direction.

Next, an experiment of the first preferred embodiment will be explained, in comparison with the first to third conventional heater coils, in conjunction with the following table. In this experiment, in which a wire having a diameter of 0.39 mm is used, a heater coil has a diameter of 12 mm and a length of 10 mm, and an electric current flows through the wire is 4A, a magnetic fields is measured at a point of 3 mm from a upper surface.

| | MAGNETIC FIELD STRENGTH (Gs) | | |
|---|---|---|---|
| | Z-AXIS | X-AXIS | Y-AXIS |
| EMBODIMENT 64 | 0.16 | 0 | 0.02 |
| FIRST CONVENTIONAL 14 | 1.92 | 0.1 | 0.34 |
| SECOND CONVENTIONAL | 0.52 | 0.11 | 0.41 |
| THIRD CONVENTIONAL | 0.33 | 0.12 | 0.98 |

According to the experiment, it is found that the first preferred embodiment has a magentic field significantly smaller than the conventional heater coils, so that an output noise of an electron tube is decreased approximately 10 dB.

Figure 15:
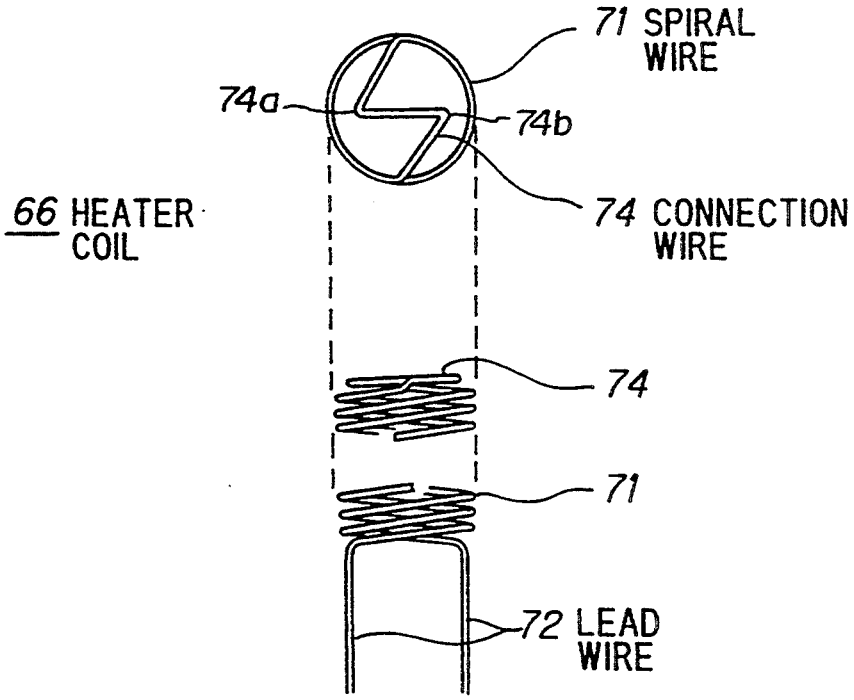
FIG. 15 is a top-and-front view showing a heater coil of a second preferred embodiment according to the invention.

FIG. 15 shows the heater coil 66 of a second preferred embodiment according to the invention, which is made of a single wire of tungsten having a diameter of 0.15 mm, and includes a spiral wire 71 double-wound to be cylindrical having a diameter of 5 mm, lead wires 72 connected to a power supply (not shown), and a connection wire 74 having two bent portions 74*a* and 74*b*. The heater coil 66 is shaped in the same manner as the heater coil 64 of the first preferred embodiment by using the instrument 72. According to the second preferred embodiment, a magnetic field is decreased approximately twenty percent as compred with the convnetional one, because the cancellation of opposite direction magnetic fields is realized by use of the two bent portions 74*a* and 74*b*.

Although the invention has been described with respect to specific embodiment for complete and clear disclosure, the appended claims are not to be thus limited but are to be construed as embodying all modification and alternative constructions that may occur to one skilled in the art which fairly fall within the basic teaching herein set forth.

What is claimed is:

1. A heater coil for an electron tube, comprising:

a pair of lead wires positioned at two opposite points on a cross section circle having a predetermined radius, said lead wires being adapted to be connected to an AC power supply;

a heater of a cylindrical shape having a circular cross section with said predetermined radius, said heater being defined by spirally wound first and second wires, the spirals of said first and second wires being interleaved with successive turns adjacent each other along substantially an entire length of said cylinder and with ends appearing at diametrically opposite points in a top plane and a bottom plane of said circular cross section of said cylindrical shape, said first and second wires being correspondingly connected to said lead wires in said bottom plane of said circular cross section; and a connection wire for connecting said first and second wire by extending between said two diametrically opposite points in said top plane of circular cross section, said connection wire being bent in at least two locations intermediate said opposing points in order to provide at least thre striaght and non-aligned segments of said connection wire in said top plane of said circular cross section, and said at least three non-aligned segments being mutually positioned within the diameter to generate mutually cancelling magnetic fields generated by current in at least two of said three segment portions.

2. A heater coil for an electron tube, comprising:

a spiral wire which is double-wound to be cylindrical having a predetermined diameter, extending in a vertical direction to an electron emission face of a cathode; and a connection wire which is formed on an upper face of said spiral wire and in a horizontal plane, and said connection wire is shaped to have at least two bent portions in the horizontal plane, said at least two bent portions forming said connection wire into at least three non-aligned straight wire sections positioned in areas off a straight line connecting starting and terminating points of said connection wire so that magnetic fields produced by electrical current in said straight wire sections mutually cancel each other.

3. A heater coil for an electron tube, according to claim 2, wherein:

said cylinder of spiral wire is shaped to have a diameter of less than 15 mm.

4. A heater coil for an electron tube, according to claim 2, wherein:

said cylinder of spiral wire is shaped to have a diameter of approximately 12 mm.

5. A heater coil for an electron tube, according to claim 4, wherein:

said connection wire is shaped to be meanderingly bent.

6. A heater coil for an electron tube, according to claim 2, wherein:

said cylinder of spiral wire is shaped to have a diameter of less than 5 mm.

7. A heater coil for an electron tube, according to claim 6, wherein:

said connection wire is shaped to have two bent portions.

* * * * *